US009437338B2

(12) United States Patent
Sayano et al.

(10) Patent No.: US 9,437,338 B2
(45) Date of Patent: Sep. 6, 2016

(54) SOLIDIFICATION METHOD OF RADIOACTIVE WASTE

(71) Applicant: KABUSHIKI KAISHA TOSHIBA, Minato-ku (JP)

(72) Inventors: Akio Sayano, Kanagawa-ken (JP); Shohei Kawano, Kanagawa-ken (JP); Yoshiyuki Kawaharada, Saitama-ken (JP); Masamichi Obata, Tokyo-to (JP); Hirotada Hayashi, Kanagawa-ken (JP); Yusuke Nohara, Tokyo-to (JP)

(73) Assignee: Kabushiki Kaisha Toshiba, Minato-ku (JP)

( * ) Notice: Subject to any disclaimer, the term of this patent is extended or adjusted under 35 U.S.C. 154(b) by 245 days.

(21) Appl. No.: 14/323,670

(22) Filed: Jul. 3, 2014

(65) Prior Publication Data

US 2015/0011816 A1 Jan. 8, 2015

(30) Foreign Application Priority Data

Jul. 5, 2013 (JP) ..... 2013-142068

(51) Int. Cl.

| | |
|---|---|
| ***G21F 9/16*** | (2006.01) |
| ***G21F 9/30*** | (2006.01) |
| ***G21F 9/12*** | (2006.01) |

(52) U.S. Cl.

CPC ..... *G21F 9/302* (2013.01); *G21F 9/12* (2013.01); *G21F 9/125* (2013.01); *G21F 9/16* (2013.01); *G21F 9/162* (2013.01)

(58) Field of Classification Search

CPC ..... G21F 9/16
USPC ..... 588/9
See application file for complete search history.

(56) References Cited

U.S. PATENT DOCUMENTS 2,918,700 A * 12/1959 Hatch ..... G21F 9/12 106/287.17
6,440,884 B1 * 8/2002 Devagnanam ..... C04B 33/1321 264/679

FOREIGN PATENT DOCUMENTS

| | | |
|---|---|---|
| JP | 2807381 | 7/1998 |
| JP | 3071513 | 5/2000 |
| JP | 2014-048187 | 3/2014 |

* cited by examiner

*Primary Examiner* — Edward Johnson
(74) *Attorney, Agent, or Firm* — Oblon, McClelland, Maier & Neustadt, L.L.P.

(57) ABSTRACT

A solidification method of radioactive waste is provided, including kneading a binder and an inorganic adsorbent to obtain a kneaded object, the in organic adsorbent included radionuclides; extruding the kneaded object to obtain an extruded material object; cutting the extruded material object to obtain at least one extruded material block; and firing the at least one extruded material block to solidify the at least one extruded material block.

6 Claims, 5 Drawing Sheets

| | | (A) | (B) |
|---|---|---|---|
| Experiment condition | Main component of inorganic absorbent | chabazite | CST |
| | Binder (bentonite) | 5% | 30% |
| | Time for kneading | 10 minutes | 10 minutes |
| | Water in the kneading object | 35% | 35% |
| | Cross-section of the extruded material block | 15×36 $mm^2$ | 25×25 $mm^2$ |
| | Kneading object put in the extruder | 5 Kg | 5 Kg |
| | Speed for extruding | 30 mm / min | 30 mm / min |
| | Cutting length | 200 mm | 200 mm |
| | Fireing atmosphere | the air | the air |
| | Firing temperature | 900 ℃ | 900 ℃ |
| | Time for firing | 3 hours | 3 hours |
| Solidified body | Size | 11×27×190 $mm^3$ | 19×19×150 $mm^3$ |
| | Bulk density | 2.4 $g/cm^3$ | 2.1 $g/cm^3$ |
| | Solidified body / Inorganic adsorbent × 100 | 39% | 56% |
| | Volatilization volume of $^{137}Cs$ | under 0.01 % | under 0.01 % |
| | Compressive strength | over 50 Mpa | over 50 Mpa |

FIG. 4

| | | (C) | (D) |
|---|---|---|---|
| Experiment condition | Main component of inorganic absorbent | chabazite | CST |
| | Binder (Kaolin) | 30% | 60% |
| | Time for kneading | 10 minutes | 10 minutes |
| | Water in the kneading object | 29% | 32% |
| | Cross-section of the extruded material block | 50×100 $mm^2$ | 50×100 $mm^2$ |
| | Kneading object put in the extruder | 20 Kg | 20 Kg |
| | Speed for extruding | 30 mm / min | 30 mm / min |
| | Cutting length | 200 mm | 200 mm |
| | Fireing atmosphere | the air | the air |
| | Firing temperature | 900 ℃ | 900 ℃ |
| | Time for firing | 3 hours | 3 hours |
| Solidified body | Size | 49×98×196 $mm^3$ | 44×88×176 $mm^3$ |
| | Bulk density | 2.4 $g/cm^3$ | 2.1 $g/cm^3$ |
| | Solidified body / Inorganic adsorbent × 100 | 67% | 100% |
| | Volatilization volume of $^{137}Cs$ | under 0.01 % | under 0.01 % |
| | Compressive strength | over 50 Mpa | over 50 Mpa |

FIG. 5

SOLIDIFICATION METHOD OF RADIOACTIVE WASTE

CROSS-REFERENCE TO RELATED APPLICATION

This application is based upon and claims the benefit of priority from Japanese Patent Application No. 2013-142068, filed on Jul. 5, 2013; the entire contents of which are incorporated herein by reference.

FIELD

Embodiments described herein relate generally to a solidification method of radioactive waste.

BACKGROUND

If all the electric supply for a Boiling-Water Reactor (BWR) stops in consequence of a big earthquake or tsunami, water is provided into a reactor pressure vessel (RPV) to cool core fuel in the RPV. The enormous amount of water poured into the RPV could be contaminated by radionuclides leaked from the melted core fuel.

To clean the contaminated water, radionuclides in the contaminated water are adsorbed by adsorbent. The adsorbent after adsorbing radionuclides is presumed to adsorb radioactive cesium ($^{137}Cs$) contained in the core fuel and presumed to emit high radiation. The adsorbent after adsorbing radionuclides is treated as radioactive waste and is needed to be solidified stably for long-term storage in a dedicated area for radioactive waste.

In a known solidification method of radioactive waste in Japanese patent publication No. 06-138298, a crushed inorganic ion exchange resin adsorbing cesium and/or strontium is pressure molded using a rubber press, and the molded resin is sintered in an atmospheric furnace at temperatures around 1200° C. The crushed inorganic ion exchange resin comprises composite moldenite, zeolite, or a mixture of them.

In another known solidification method of radioactive waste in Japanese patent publication No. 05-080197, a ceramic waste including a radioactive substance is filled in a metal capsule after an alkaline aqueous solution is added into the ceramic waste. The ceramic waste in the metal capsule is subjected to a hot hydrostatic pressurizing process to form a solidified body.

BRIEF DESCRIPTION OF THE DRAWINGS

FIG. 4 shows property data of experiment conditions and a solidified body including bentonite as binder, according to an embodiment; and FIG. 5 shows property data of experiment conditions and a solidified body including kaolin as binder, according to an embodiment.

DETAILED DESCRIPTION

According to an embodiment, a solidification method of radioactive waste is provided, comprising: kneading a binder and an inorganic adsorbent to obtain a kneaded object, the inorganic adsorbent including radionuclides; extruding the kneaded object to obtain an extruded material object; cutting the extruded material object to obtain at least one extruded material block; and firing the at least one extruded material block to solidify the at least one extruded material block.

Reference will now be made in detail to exemplary embodiments, examples of which are illustrated in the accompanying drawings. Whenever possible, the same reference numbers will be used throughout the drawings to refer to the same or like parts.

Figure 1:
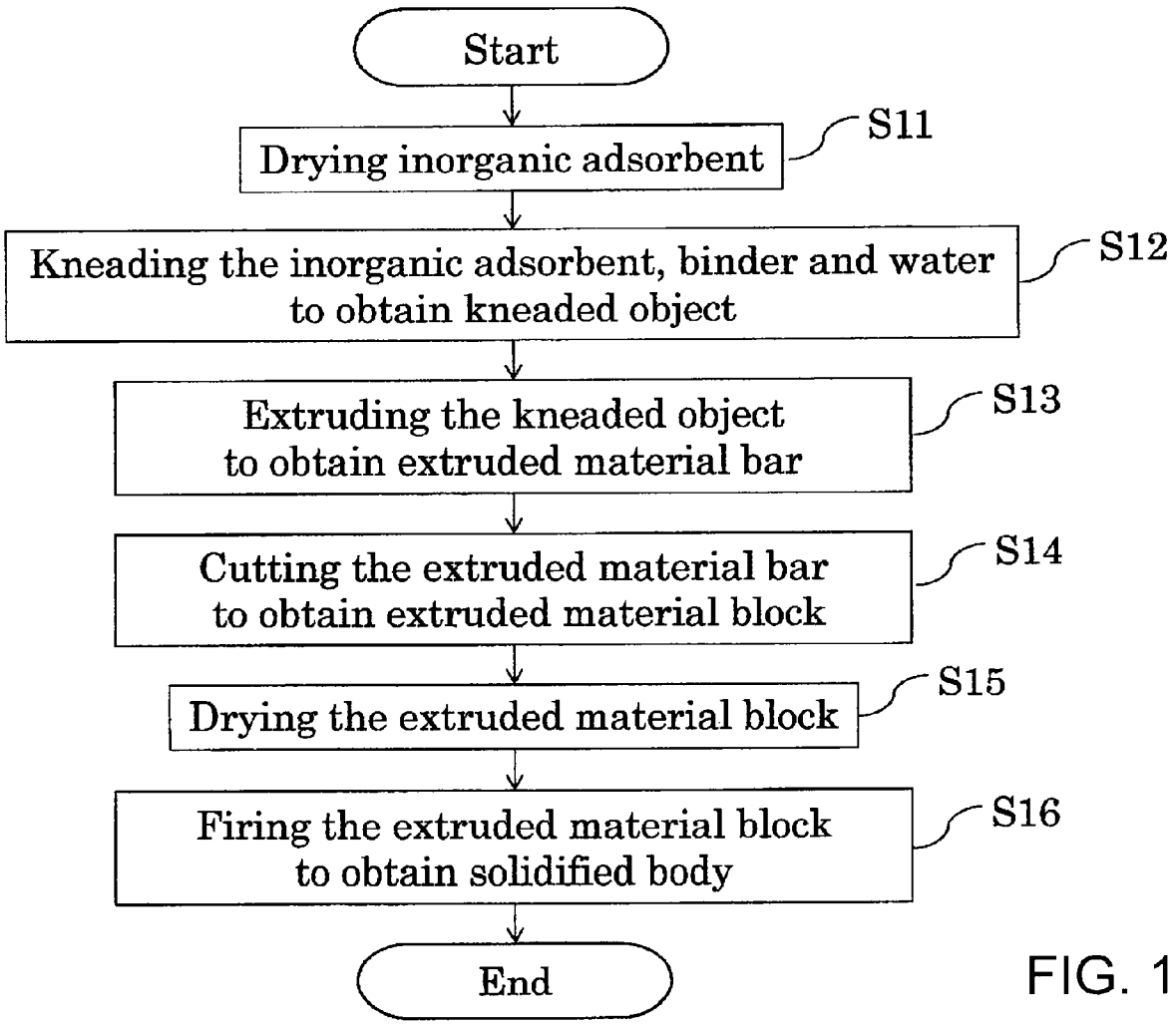
FIG. 1 illustrates a flow chart of a solidification process to solidify radioactive waste, according to an embodiment.

According to one exemplary embodiment in FIG. 1, at first, inorganic adsorbent adsorbing radionuclide is dried (S11). The dried inorganic adsorbent, binder, and water are mixed and kneaded to obtain a kneaded object (S12). The kneaded object is extruded to obtain an extruded material object made of the kneaded object (S13). The extruded material object is cut into an appropriate length to obtain one or more extruded material blocks (S14). The extruded material blocks are dried (S15). And, the dried extruded material blocks are fired to obtain one or more solidified bodies (S16).

An inorganic adsorbent contain chabazite or crystalline silico titanate (CST) as a major ingredient may be used in S11. For example, not only chabazite or CST may be used, but also any substance that will adsorb radionuclides (for example, the radionuclide $^{137}Cs$) may be used as the inorganic adsorbent (e.g., inorganic adsorbent 11, shown later with reference to FIG. 2). Also, for example, aluminosilicate, clinoptilolite, or hershlite may be used as the inorganic adsorbent.

In S12, the inorganic adsorbent kneaded with binder becomes flexible and can be formed easily. For example, a clayey mineral is elected as a major ingredient of the binder. For example, bentonite, kaolinite, halloysite, chrysotile, pyrophyllite, talc, muscovite, phlogopite, sericite, chlorite, beidellite, and vermiculite can be used as the binder. Preferably, for example, bentonite or kaolin are appropriate as the binder because they can be easily obtained. Generally, cellulose ether-based organic substances could be used as the binder, but they could be decomposed by exposure to radioactive rays.

In this embodiment, for example, bentonite is elected as the binder. An appropriate amount of the binder kneaded with the inorganic adsorbent depends on the shape and the size of the extruded material object or on the substance used as the binder. In the inventors' experience, the kneaded object containing binder under 4% of the inorganic adsorbent is not flexible enough and often gets cracked during the extrusion. On the other hand, when more binder is kneaded with the inorganic adsorbent, the rate of radionuclides in the kneaded object is lower. A minimum amount of the binder is preferred to be mixed with the inorganic adsorbent unless the extruded material bar gets cracked.

For example, for the inorganic adsorbent containing chabazite as a major ingredient, 4~8% bentonite of the inorganic adsorbent is preferred. For the inorganic adsorbent containing CST as a major ingredient, 25~35% bentonite of the inorganic adsorbent is preferred. Not applying only to bentonite, 4~60% the binder of the inorganic adsorbent is preferred to be mixed with the inorganic absorbent. 5~30% the binder is more preferred to be mixed with the inorganic absorbent. The percentages of the binder are percentages by total inorganic absorbent weight.

In S12, 30% water of the inorganic adsorbent is preferred to be mixed with the inorganic adsorbent and the binder. The percentage of the water is percentage by total inorganic absorbent weight.

The details of S13 and S14 are discussed in more depth later.

In S15, the extruded material blocks are dried for a day.

Hereinafter, a solidification system 10 for radioactive waste will be described with referent to FIG. 2. The solidification system 10 includes a kneading machine 19 for making the kneaded object 13, an extruder 24 to form the extruded material object 13*a* from the kneaded object 13, a belt conveyor 21 to convey the extruded material object 13*a*, and a cutting machine 22.

The kneading machine 19 kneads the inorganic adsorbent 11 with the binder 12 and water 17 to make the kneaded object 13. An exit 14 for the kneaded object 13 is provided in the kneading machine 19. The kneaded object 13 is discharged from the exit 14 and charged into the extruder 24.

The extruder 24 extrudes the kneaded object 13 from an extrusion pore 18 to form the kneaded object 13 into the extruded material object 13*a*. The extrusion pore 18 decides a cross-section shape perpendicular to direction for the extrusion of the extruded material object 13*a*. For example, the extrusion pore 18 could be an oblong figure, square, or circle.

The extruder 24 could include a screw 16 and a motor 15 as means for extruding the kneaded object 13. The motor 15 rotates the screw 16.

The extruded material object 13*a* is extruded on the belt conveyor 21 and transferred to the cutting machine 22 by the belt conveyor 21. The extruded material object 13*a* is cut to the predetermined length by the cutting machine 22 to be made into one or more extruded material blocks 13*b*. The cutting machine 22 could cut the extruded material object 13*a* by piano wire 23.

The one or more extruded material blocks 13*b* are then fired to be made into one or more solidified bodies. The solidified bodies are stored tightly in a container (not shown). For example, the container may be a 430×430×1340 mm cuboid rectangular parallelepiped. A solidified body shaped into a cuboid can be stored tightly in the container.

For another example, the container may be a cylinder having an inside diameter of 420 mm, and a height of 1340 mm. A solidified body shaped into a column can be stored tightly in the container.

The shapes of containers are not limited to the containers noted above. The shapes of the solidified bodies are determined in response to the shapes of containers. The shapes of the solidified bodies can be adjusted by changing the shape or size of the extrusion pore 18 and can be cut to a specified length by the cutting machine 22. Therefore, it is easier to form and adjust the solidified body into various shapes by extrusion than by pressure molding.

The solidified body contains radionuclides. Storing the solidified body in the container needs to be done by remote-controlled robot. Solidified bodies in the shape of a cuboid or a column are easy to be handled by a robotic arm.

Figure 2:
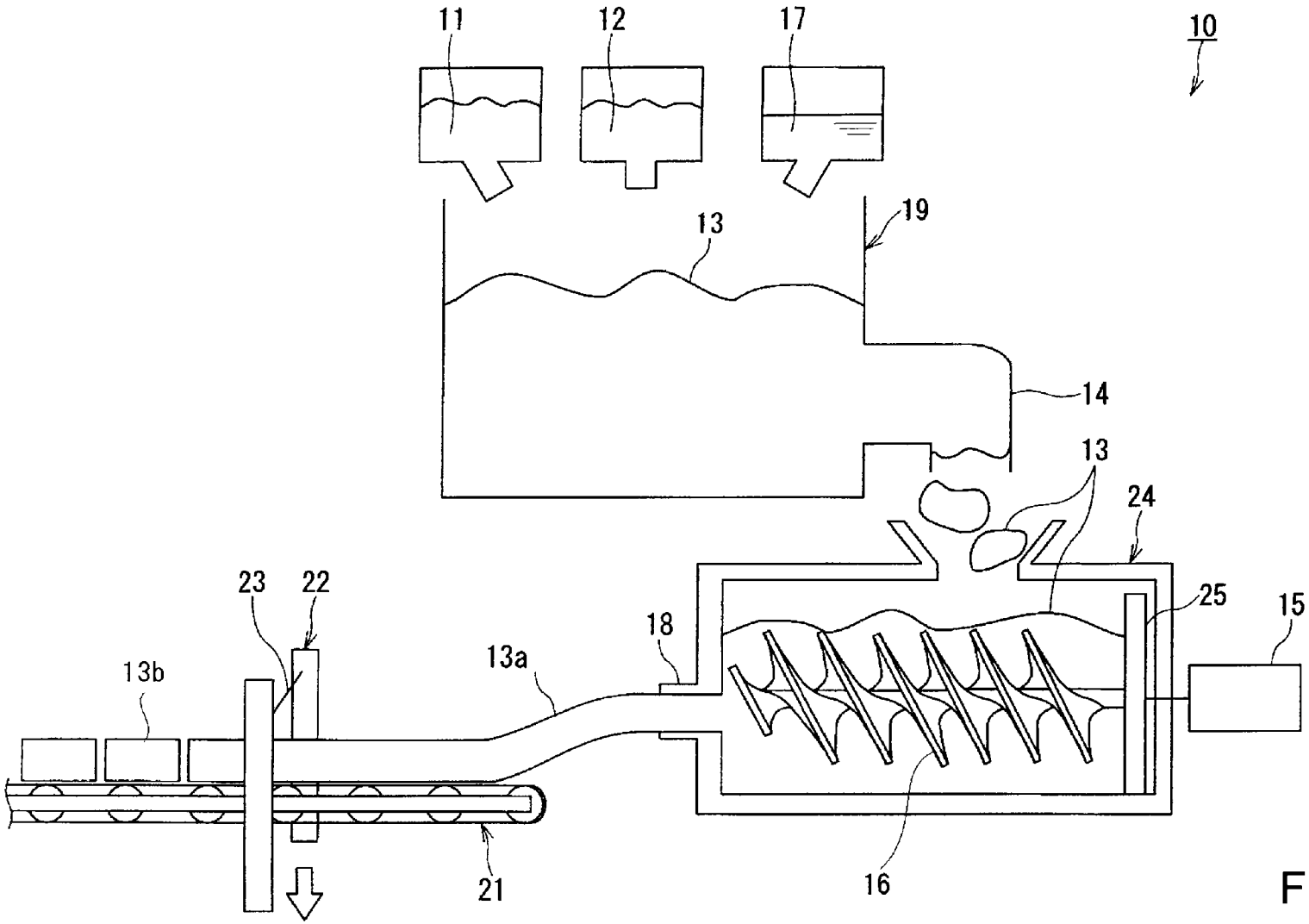
FIG. 2 shows a structure of a solidification system for radioactive waste, according to an embodiment.

As shown in FIG. 2, the kneading machine 19 and the extruder 24 are independent machines, but need not be limited to such an arrangement. The kneading machine 19 and the extruder 24 could instead be structurally-integrated on demand from their installation space. Also, a publicly available extruder for manufacturing bricks could be applied to the solidification system 10.

Hereinafter, demonstration experiments consistent with the embodiments discussed above will be described. Five experiments will be described. In the first experiment, the effect of temperature on the solidified body during S16 will be described. In the second experiment, the solidified body made of chabazite and bentonite will be described. In the third experiment, the solidified body made of CST and bentonite will be described. In the fourth experiment, the solidified body made of chabazite and kaolin will be described. In the fifth experiment, the solidified body made of CST and kaolin will be described.

(The First Experiment)

The effect of firing temperature on the solidified body during S16 will be described with reference to FIGS. 3 (A) and 3 (B).

Figure 3A:
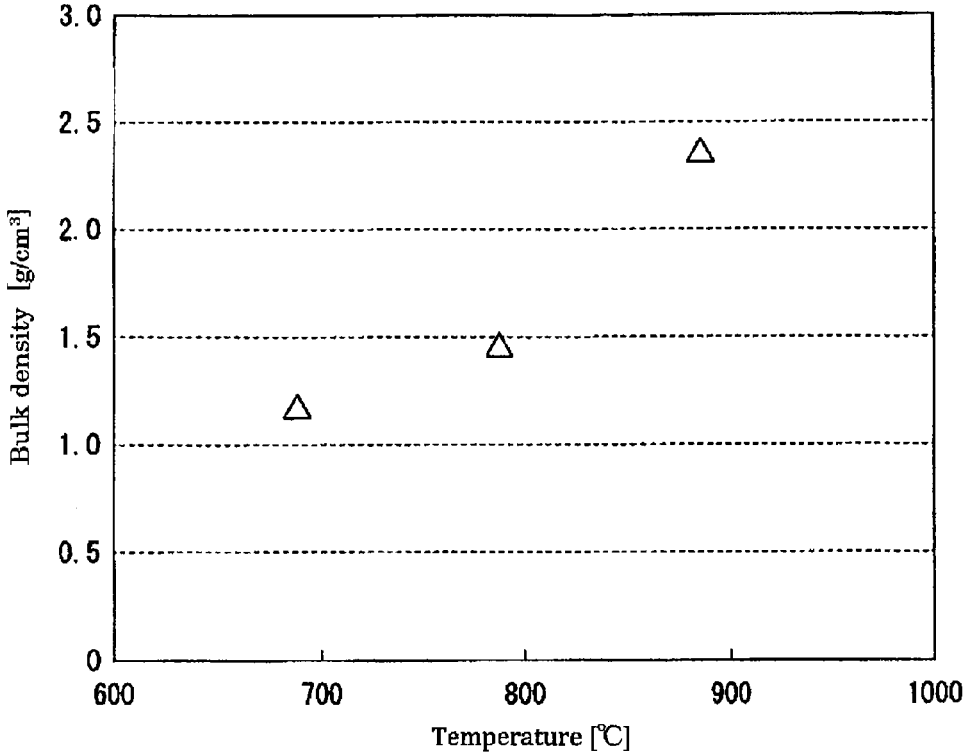
FIG. 3(A) shows a graph of bulk density as a function of temperature during firing of extruded material blocks made of an inorganic adsorbent including mainly chabazite, according to an embodiment.
Figure 3B:
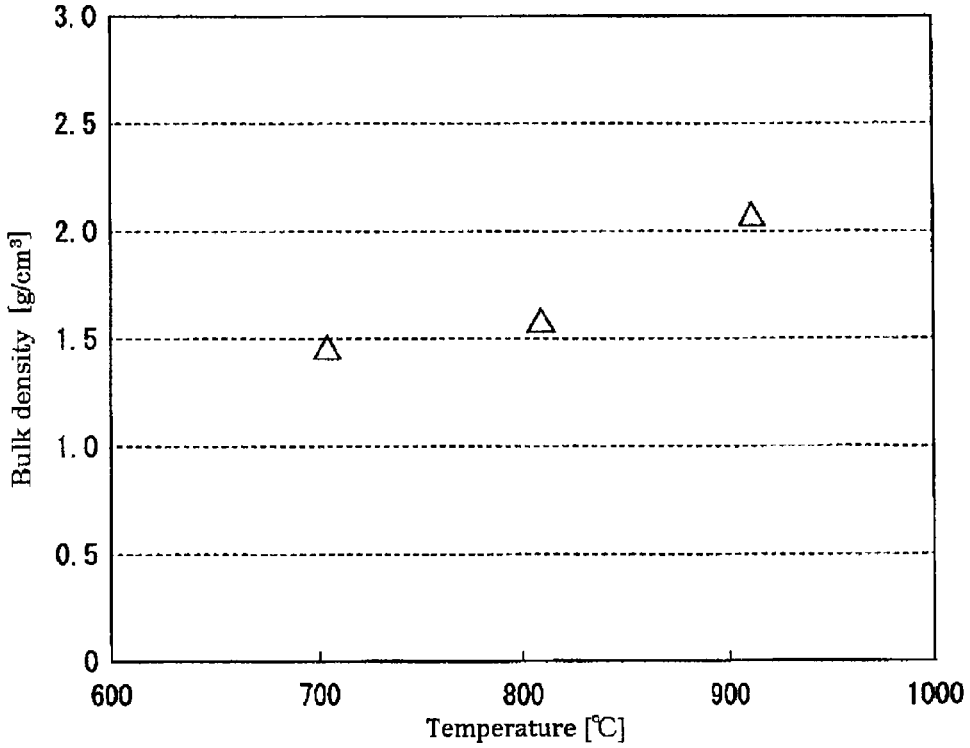
FIG. 3(B) shows a graph of bulk density as a function of temperature during firing of extruded material blocks made of an inorganic adsorbent including mainly crystalline silico titanate (CST), according to an embodiment.

FIG. 3 (A) shows how density corresponds to temperature during firing of the extruded material blocks made of an inorganic adsorbent including mainly chabazite. FIG. 3 (B) shows how density corresponds to temperature during firing of the extruded material blocks made of an inorganic adsorbent including mainly CST. The time during the firing is 1-4 hours.

According to FIGS. 3 (A) and 3 (B), bulk density of the solidified bodies fired at temperature set in a range of 700-900 degrees Celsius in the air (e.g., ambient atmosphere) is increased with a rise in temperature.

The compressive strength of the solidified bodies fired at temperature set under 700 degrees Celsius was insufficient. On the other hand, $^{137}Cs$ volatilized at temperature set over 900 degrees.

By firing the extruded material block 13*b* at temperature set in a range of 700-900 degrees Celsius in the air (e.g., ambient atmosphere) for 1~4 hours, bulk density and $^{137}Cs$ density of the solidified body is acceptable.

(The Second Experiment)

Properties of the solidified body made of chabazite and bentonite will be described with FIG. 4. In column (A) of FIG. 4, chabazite is used as the main component of the inorganic adsorbent and bentonite is used as the main component of the binder. The chabazite has been adsorbing $^{137}Cs$ in advance.

In S12 (shown in FIG. 1), the binder 12 and water 17 were added to the inorganic adsorbent 11 (shown in FIG. 2). They were kneaded by the kneading machine 19 for about 10 minutes and the kneaded object 13 was made. The amount of the binder was 5% of the inorganic adsorbent. Water included in the kneaded object 13 was 35% of the kneaded object 13.

In S13, 5 kg of the kneaded object 13 was put in the extruder 24. The motor 15 rotated the screw 16, and the screw 16 squeezed the kneaded object 13 into the extrusion pore 18 with kneading. The size of the extrusion pore 18 was 15×36 $mm^2$. 30 mm of the extruded material object 13*a* was extruded from the extrusion pore 18 per minute. The extruded material object 13*a* was rectangle having a cross-section of 15×36 $mm^2$.

In S14, the extruded material object 13*a* was conveyed to the cutting machine 22 by the belt conveyor 21. The cutting machine 22 cut the extruded material object 13*a* every 200 mm. The size of the extruded material block 13*b* was 15×36×200 $mm^3$.

In S16, the extruded material block 13*b* was dried for about a day.

In S17, the dried extruded material block 13*b* was fired at temperature set to 900 degrees Celsius in the air (e.g., ambient atmosphere) for 3 hours by an electric furnace.

The size of the solidified body made by these processes was 11×27×190 $mm^3$. The volume of the solidified body was 39% of the volume of the inorganic adsorbent before being processed (volume of the solidified body/the volume of the inorganic adsorbent×100=39%). The bulk density of the solidified body was 2.4 $g/cm^3$. Volatilization volume of $^{137}Cs$ was under 0.01%. 0.01% volatilization could be taken as no volatilization. The compressive strength of each arbitrarily—selected three solidified bodies was 50 MPa and over.

(The Third Experiment)

Next, properties of the solidified bodies containing CST as the main component of the inorganic adsorbent will be described with reference to column (B) of FIG. 4. The CST has been adsorbing $^{137}Cs$ in advance. Bentonite is the main component of the binder.

In S12 (shown in FIG. 1), the amount of binder kneaded with was 30% of the inorganic absorbent. Viscosity of CST is lower than chabazite. CST needs more binder than chabazite to avoid cracks on the extruded material bar 13*a*.

In S13, to avoid cracks on the extruded material bar 13*a*, the extrusion pore 18 was 25×25 $mm^2$ square. The extruded material bar 13*a* extruded from the square extrusion pore 18 can take load equally and can avoid cracking. On the other hand, by being extruded from the oblong extrusion pore 18, the extruded material bar 13*a* takes load sectionally.

Other conditions were the same with the second experiment. The time for kneading was 10 minutes. Water contained in the kneaded object 13 was 35%. 5 kg of the kneaded object 13 was put in the extruder 24. 30 mm of the extruded material bar 13*a* was extruded from the extrusion pore 18 per minute. The length of the extruded material block 13*b* was 200 mm. The extruded material block 13*b* was fired at temperature set 900 degrees Celsius in the air (e.g., ambient atmosphere) for 3 hours.

The size of the solidified body made by these processes was 19×19×150 $mm^3$. The volume of the solidified body was 56% of the volume of the inorganic adsorbent before being processed. The bulk density of the solidified body was 2.1 $g/cm^3$. Volatilization volume of $^{137}Cs$ was under 0.01%. The compressive strength of each arbitrarily—selected three solidified bodies was 50 MPa and over.

By the second and the third experiment, the solidified body made of inorganic adsorbent containing chabazite or CST as main component can be solidified. The solidification bodies made by the process of this embodiment were reduced in volume and sufficiently hardened compared with the untreated inorganic adsorbent.

(The Fourth Experiment)

Properties of the solidified bodies containing chabazite and kaolin made by the solidification method noted above will now be described with reference to column (C) of FIG. 5. Chabazite is used as the main component of the inorganic adsorbent and kaolin is used as the main component of the binder. The chabazite has been adsorbing $^{137}Cs$ in advance.

In S12 (shown in FIG. 1), the amount of binder kneaded with was 30% of the inorganic absorbent. Viscosity of kaolin is lower than bentonite, so more kaolin needs to be added to the inorganic adsorbent than bentonite. The inorganic adsorbent 11, the binder 12 and water 17 were kneaded for about 10 minutes by the kneading machine 19. The kneaded object 13 contained about 29% water.

In S13, the extrusion pore 18 was 50×100 $mm^2$. 20 kg of the kneaded object 13 was put in the extruder 24. 30 mm of the extruded material bar 13*a* was extruded from the extrusion pore 18 per minute.

In S14, the extruded material object 13*a* was cut every 200 mm. The size of the extruded material block 13*b* was 50×100×200 $mm^3$.

In S15, the extruded material block 13*b* was fired at temperature set to 900 degrees Celsius in the air (e.g., ambient atmosphere) for 3 hours.

Other conditions of this experiment were the same as the conditions of the second experiment.

The size of the solidified bodies made by these processes was 49×49×196 $mm^3$. The volume of the solidified body was 67% of the volume of the inorganic adsorbent before being processed. The bulk density of the solidified body was 2.07 $g/cm^3$. Volatilization volume of $^{137}Cs$ was under 0.01%. The compressive strength of each arbitrarily—selected three solidified bodies was 50 MPa and over. The solidification bodies made by the process of this embodiment were reduced in volume and sufficiently hardened compared with the untreated inorganic adsorbent.

(The Fifth Experiment)

Properties of the solidified bodies made of CST and kaolin by the solidification method noted above will be described with reference to column (D) of FIG. 5. CST is used as the main component of the inorganic adsorbent. Kaolin is used as the main component of the binder. The CST has been adsorbing $^{137}Cs$ in advance.

In S12 (shown in FIG. 1), the amount of binder kneaded with was 60% of the inorganic absorbent. Viscosity of CST is lower than bentonite. To avoid cracks on the extruded material bar 13*a*, CST needs more kaolin added than chabazite. By the same reason, more water was added to the inorganic absorbents and the binder. The kneaded object contained about 32% water.

The other conditions of this experiment were the same as that of the fourth experiment.

The size of the solidified bodies made by these processes was 44×88×176 $mm^3$. The volume of the solidified body was 100% of the volume of the inorganic adsorbent before being processed. The bulk density of the solidified body was 1.68 $g/cm^3$. Volatilization volume of $^{137}Cs$ was under 0.01%. The compressive strength of each arbitrarily—selected three solidified bodies was 50 MPa and over. The solidification bodies made by the process of this embodiment were sufficiently hardened compared with the untreated inorganic adsorbent.

By the fourth and the fifth experiments, the solidified body made of inorganic adsorbent containing chabazite or CST as main component can be solidified by using kaolin as the binder. The solidified bodies made by the process of this embodiment can prevent increasing the volume and can be sufficiently hardened.

As described above, in this solidification method, the inorganic adsorbent is extruded to be solidified. Therefore, this solidification method may be capable of reducing the time for making the solidified body. Or, a large amount of inorganic adsorbent can be solidified in limited time.

In addition, the solidified bodies made by the method of this embodiment can be sufficiently hardened. Therefore, the solidified bodies can be stored in storage houses for many decades.

The method of this embodiment can prevent volatilizing of radionuclides during making of the solidified bodies from the inorganic absorbent that has already absorbed radionuclides.

While certain embodiments, experiments, and experimental results have been described, these embodiments have been presented by the way of example only, and are not intended to limit the scope of the claimed invention. Indeed, the novel embodiments described herein may be embodied a variety of other forms; furthermore, various omissions, substitutions, and change changes in the form of the embodiments described herein may be made without departing from the spirit of claimed invention. The accompanying claims and their equivalents are intended to cover such forms or modifications as would fall within the scope and spirit of the invention disclosed and claimed herein.

What claimed is:

1. A solidification method of radioactive waste, comprising:

preparing an inorganic adsorbent absorbed with a radionuclide;

kneading a binder and the inorganic adsorbent absorbed with the radionuclide to obtain a kneaded object;

extruding the kneaded object to obtain an extruded material object;

cutting the extruded material object to obtain at least one extruded material block; and firing the at least one extruded material block to solidify the at least one extruded material block.

2. The solidification method of radioactive waste according to claim 1, wherein the binder contains clayey mineral.

3. The solidification method of radioactive waste according to claim 2, wherein the clayey mineral is composed primarily of bentonite or kaolin.

4. The solidification method of radioactive waste according to claim 1, wherein the binder is added to the inorganic adsorbent in an amount of 4%~60% of the inorganic adsorbent.

5. The solidification method of radioactive waste according to claim 1, wherein the inorganic adsorbent includes chabazite or crystalline silico titanate.

6. The solidification method of radioactive waste according to claim 1, wherein the at least one extruded material block is fired during the firing at temperature set in a range of 700-900 degrees Celsius in an ambient atmosphere.

* * * * *